United States Patent [19]

Krut

[11] Patent Number: 4,753,623

[45] Date of Patent: Jun. 28, 1988

[54] MAGNETIC SPINNER DEVICE

[76] Inventor: William A. Krut, 158 20th St., Pittsburgh, Pa. 15203

[21] Appl. No.: 942,215

[22] Filed: Dec. 16, 1986

[51] Int. Cl.[4] ..... A63H 33/26

[52] U.S. Cl. ..... 446/133; 446/256; 272/8 N; 335/306

[58] Field of Search ..... 446/129, 131, 132, 133, 446/135, 138, 236, 256, 257, 259, 262, 264, 266, 484, 233; 272/8 N, 8 D; 446/233; 335/302, 306

[56] References Cited

U.S. PATENT DOCUMENTS

| | | | |
|---|---|---|---|
| 920,895 | 5/1909 | Kerr | 446/133 |
| 2,702,191 | 2/1955 | Lemelson | 446/129 |
| 2,994,984 | 8/1961 | Luchsinger | 446/132 |
| 3,191,341 | 6/1965 | Martin | 446/264 |
| 3,594,943 | 7/1971 | Ryan et al. | 446/259 |
| 3,801,095 | 4/1974 | Woron | 446/133 |
| 3,855,725 | 12/1974 | Tollefson | 446/132 |
| 3,955,315 | 5/1976 | Goodman | 446/133 |
| 4,200,283 | 5/1980 | Andrews et al. | 446/259 |
| 4,382,245 | 5/1983 | Harrigan | 335/306 |
| 4,408,413 | 10/1983 | Hyland et al. | 446/259 |
| 4,538,999 | 9/1985 | Orlowski | 446/259 |
| 4,575,346 | 11/1986 | Ogawa | 446/259 |
| 4,643,692 | 2/1987 | Magers | 446/259 |

FOREIGN PATENT DOCUMENTS

| | | | |
|---|---|---|---|
| 3226692 | 1/1984 | Fed. Rep. of Germany | 446/259 |
| 1038949 | 10/1953 | France | 446/264 |
| 86/02280 | 4/1986 | PCT Int'l Appl. | 446/256 |
| 20651 | of 1896 | United Kingdom | 446/256 |
| 1001950 | 3/1983 | U.S.S.R. | 446/236 |

*Primary Examiner*—Robert A. Hafer

*Assistant Examiner*—Charles H. Harris

*Attorney, Agent, or Firm*—Parmelee, Miller, Welsh & Kratz

[57] ABSTRACT

A magnetically operated rotative amusement device or unit of a substantially self-starting nature has a see-through or transparent container or bowl-like support base provided with a lower, centrally disposed, pivot-receiving socket. A spinner has a pivot pin adapted to rest in the socket and to extend upwardly towards an open mouth portion of the support base. The support base has either an inner collar or a relatively narrow bowl to support the spinner in an upright, slightly tilted position in a ready-to-operate relation therein. A dome-shaped lid is used to close-off an open mouth portion of the support base and has a centrally, downwardly extending, permanent magnet supported in a vertically adjustable relation in which it is slightly spaced from and aligned with a second and opposing magnet carried by an upper end of the spinner. The spinner may be caused to rotate or spin by moving the lid in an angular relation to a closing-off position from a side of the bowl that is opposite to a tilted positioning of the spinner within the bowl. If the lid is in place or in a permanently mounted position with respect to the bowl, then spinning movement may be effected by slightly tilting the support base. Rotation of the spinner thus accomplished will continue for an effective period of approximately two or three minutes using a pivot pin on the spinner part and the socket therefor of a relatively hard and smooth material of minimized frictional resistance, for example, a tapered-end steel pivot pin and a socket of glass.

13 Claims, 1 Drawing Sheet

MAGNETIC SPINNER DEVICE

This invention relates to an in-position somewhat top-like spinner unit or rotating amusement device.

An object of the invention has been to devise a relatively simple device having a spinner part that will initiate and continue rotative or spinning movement when it or a supporting container or lid therefor is agitated or tilted.

Another object has been to devise a simple and inexpensive but highly intriguing spinner device that will, on its initial actuation, in itself thereafter, initiate and continue rotative movement for a goodly period with respect to a supporting socket.

A further object of the invention has been to devise a magnetically actuated device that will, on being tilted, initiate and continue rotative movement in one direction for an extended period of time.

These and other objects of the invention will appear to those skilled in the art from the illustrated embodiments and the claims.

DETAILED DESCRIPTION OF THE INVENTIVE CONSTRUCTION

Figure 1:
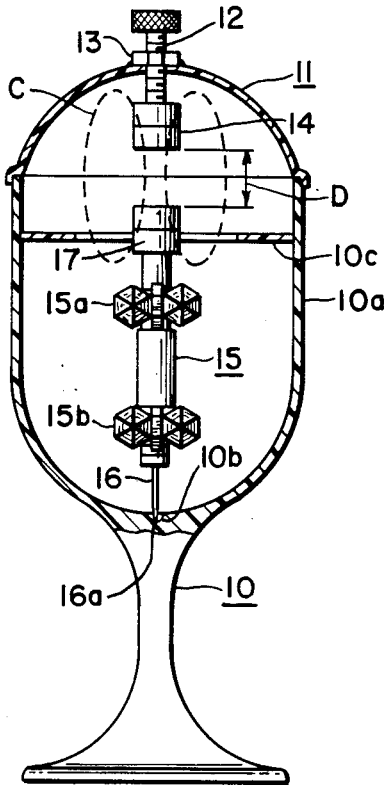
FIG. 1 is a vertical view in elevation, principally in section, showing a device of the invention in a fully vertically aligned and rotative operating position wherein two opposed magnets effect a continuous type of rotation of its spinner within a container socket.
Figure 2:
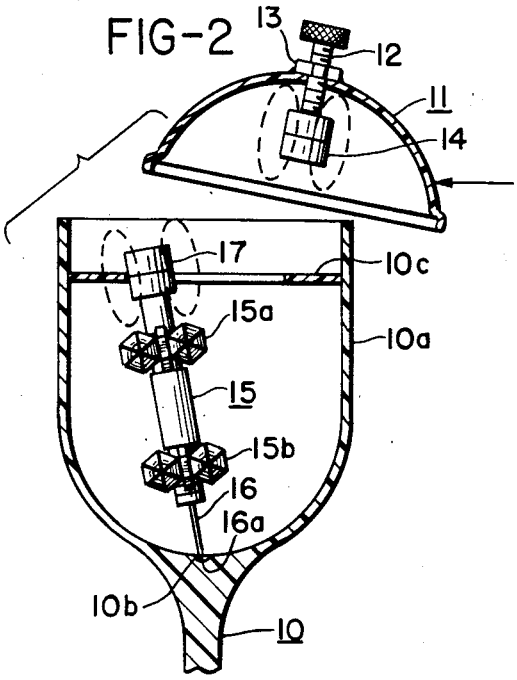
FIG. 2 is a fragmental section on the scale of and of the device of FIG. 1 showing a method of moving a magnet-carrying lid for the container to draw a spinner from its "at rest" to a fully upright position.

Referring to FIGS. 1 and 2 of the drawings, a container or bowl-shaped supporting base 10 in the nature of a stemmed goblet is shown. It has an open mouth, bowl portion 10*a* of an upwardly open construction and of a see-through type of material, such as glass or plastic. It has a footed base, such as indicated, in order that it may be placed on a table or other level surface for viewing. The bowl portion 10*a* has a removable, cover or interfitting closure lid 11 which will also preferably be of a fully transparent material such as glass or plastic, but like the bowl may be slightly translucent. A spinner part 15 is carried in a substantially upright position for the rotation within the container 10. As noted, the container 10 has an upstanding construction and is provided with a pivot pin-receiving central depression or a relatively low friction socket 10*b* within which a bevelled lower, pivot end 16*a* of a downwardly extending pivot pin 16 is adapted to fit. The pin 16 is of a relatively hard, low friction material, such as brass or steel, and the socket 10*b* is also of a relatively low friction hard material, such as glass or plastic.

The spinner part 15 may have any suitable decorative or eye-catching construction, such as faceted, colored beads 15*a* and 15*b* that are positioned along its stem portion. At its upper end, the spinner 15 carried a vertically aligned permanent magnet 17 of a symmetrical annular or circular shape, as shown. An opposed permanent magnet 14 is carried in a centered, vertically aligned, downwardly projecting relation from the lid 11 by means of an adjustment screw 12. The screw 12, as noted, extends centrally through a threaded nut 13 that is secured on the lid 11 and, at its upper end has knurled thumb head 12' for enabling its vertical adjustment. The purpose of adjusting the screw 12 is to preliminarily set an appropriate spacing between the magnets 14 and 17 in their vertically aligned, opposed-pole, operating alignment of FIG. 1. By way of example, if the diameter of circular-shaped magnets 14 and 17 is about $\frac{3}{8}$ of an inch and their length is about $\frac{3}{4}$ of an inch, then the vertical distance D between them may be about $\frac{1}{2}$ of an inch.

Referring to FIG. 2 of the drawings, the bowl 10*a* is shown provided with an inwardly extending circular flange 10*c* in order to retain the spinner 15 in a slightly tilted "at rest" position, e.g. about 15° off the vertical, as illustrated. When the spinner 15 is in such a position, then a manual, slightly tilted closing movement of the lid 11 (see FIG. 2) with respect to container bowl portion 10*a* will cause the spinner 15 to automatically become agitated (jiggled) and then initiate a one direction of continuous spinning rotative movement in the aligned upright position of FIG. 1 for an indefinite period of time, e.g. for two or three minutes, to the amazement of the viewer.

A spinning motion of the spinner 15 is accomplished by a manual, hand-engendered, swivelling rotational movement of the container 11 which appears to cause a magnetically induced swing of the spinner into a vertically aligned relation and, at the same time, to cause a centrifugal force produced rotation of it. It appears that a slight lifting of the spinner 15 is caused by the magnetic field set up between opposing North and South poles of the magnets 14 and 17 that face each other in a spaced relation, see FIGS. 1 and 3. The space D or D' between the two magnets is critical from the standpoint that if it is too close, the spinner 15 or 15' will be lifted or pulled upwardly by the magnets 14 and 17 such that they attain an abutting relation, see magnets 14' and 17' of FIG. 4. This is a nonoperating relation which has to be prevented if the spinning action is to be effected. The spacing D thus is such that a magnetic field, as shown in FIG. 1, is maintained between the two magnets, but of an insufficient force to raise the magnet 17 into abutment with the magnet 14, but of an amount that slightly raises the pin 16 of the spinner 15 and its pivot point 16*a* within the socket 10*b* to thus reduce frictional engagement therebetween. This appears to be the reason why the spinner will continue to rotate to the amazement of the onlooker. It is believed that the spinning action would continue indefinitely due to the balanced magnetic lifting force field engendered as indicated by the broken lines C of FIG. 1, if minimum friction engendered between the pivot pin end 16*a* and the socket 10*b* did not exist. Incidentally, the adjustment screw 12 is shown mounted on a nut 13 that is secured to the lid 11 as by cement in lieu of a threaded bore hole in the lid 11.

It will be noted that the spacing D is critical from the standpoint of the invention, since the two magnets 14 and 17 of opposite polarity will move into abutment with each other if they are too close. On the other hand, if they are too far apart there will be no magnetic field set up between them which is essential from the standpoint of minimizing friction between the bevelled pivot end 16*a* of the spinner 15 and the socket 10*b*, as effected by a slight magnetic lift or "up" pull on the spinner under the influence of the magnetic field. It is thus believed that manually induced rotation of the spinner 15 is continued for an unusual period of time centrifugally due to such minimized friction. It will be noted that when the two magnets are in a desired spaced-apart opposed relation, the magnetic field therebetween will cause the spinner 15 to be retained in an aligned relation with the upper magnet 14 and thus, in the embodiment shown, to cause the spinner to be retained in a free, vertical operating position without any connecting, bearing or frictional engaging means at its upper end.

Figure 3:
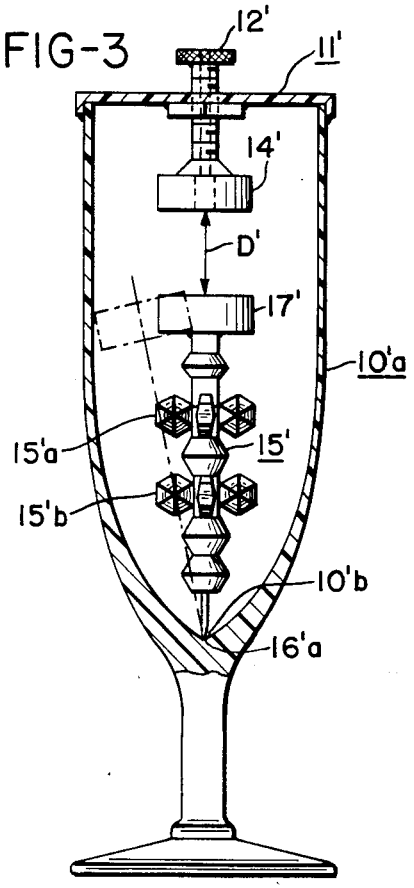
FIG. 3 is a sectional view in elevation through a modified device of the invention in which a slightly angular or sloped "at rest" positioning collar of the embodiment of FIGS. 1 and 2 is eliminated and the spinner is maintained "at rest" by a narrower diameter wall width of the container.
Figure 4:
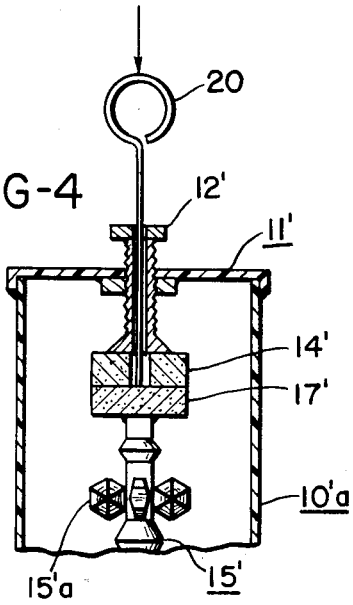
FIG. 4 is a fragmental sectional view on the scale of and of the device of FIG. 3, illustrating the use of means for pushing opposed magnets out of inadvertent abutment when, for example, the operating mechanism of the device is sealed within a container such as illustrated in FIG. 3.

In the embodiment of FIGS. 3 and 4, a container 10' has a bowl portion 10'*a* that has a smaller diameter so as to enable the spinner 15' to tilt only a slight amount, such as 13 to 15 degrees from the vertical, as indicated by the dot and dash lines of FIG. 3 when in its "at rest" position. This eliminates the need for the inner support flange or shelf 10*c* of the embodiment of FIGS. 1 and 2. It will be noted that the same reference numbers have been used in this embodiment but with added prime suffixes. In this construction, lid 11' may be securely or permanently mounted over the lip of the open mouth of the container bow 10'*a* so as to prevent tampering with the working parts thereof.

As in the previously described embodiment, an adjustment screw 12' is provided for adjusting the distance D' between the opposed north and south poles of the two magnets 14' and 17'. To illustrate the fact that different size magnets may be used, the two magnets 14' and 17' are shown of larger diameter than the magnets 14 and 17, however, they should be of substantially the same magnetic strength. If, as indicated in FIG. 3, the magnets 14' and 17' are of greater strength than those in FIG. 1, then the distance D' may be slightly greater for effecting rotation or spinning action of the spinner part 15'. For example, if the diameter of the elements 14' and 17' is ½ of an inch then D' will be in the neighborhood of about ⅝ of an inch.

It is important to note that the distance D or D' is a critical distance that can be attained by adjusting the screw 12 or 12'. If the distance is too short, then the two magnets will move into an abutting position such as shown in FIG. 4. For this reason, if as shown in FIG. 3, the lid 11' is cemented on the lip of the container bowl 10'*a*, the stem 12' and the magnet 14' are provided with through-extending bore holes so that a looped handle push pin element 20 of non-magnetic material may be used to separate the two magnets if they are inadvertently moved too close and abutment is effected. In other words, the inner end of the push element 20 may be used to move the lower magnet 17' and the spinner 15' from an upper position at which the pivot end 16'*a* of the spinner is out of the socket 10'*b* and the magnet 17' is held by magnetic force in abutment with upper magnet 14'.

The amazing part of the invention is the fact that when, for example, the lid 11 in the embodiment of FIG. 2 is moved into a covering position with the container 10 that this will cause the spinner part 15 to first wobble and then initiate an unexpected fast, one-directional rotation for a period of time. In the embodiment of FIGS. 3 and 4, tilting movement of the container 10' from the position of FIG. 3 to a slight, e.g. 15° tilt and then back to the vertically aligned position of FIG. 3 will cause the spinner 15' to bobble back and forth slightly and then initiate and continue a fast rotative movement. Although the spinner 15 or 15' may be provided with an eye attracting, faceted ornamentation 15*a* and 15*b* or 15'*a* and 15'*b*, such as shown, it can also be provided with means to produce a sound effect during its rotation.

I claim:

1. A magnetically controlled rotating spinner device which comprises, a hollow container having a vertically extending side wall and bearing socket therein at its lower end portion, a spinner part having upper and lower end portions, said spinner part having pivot means at its lower end portion to rotatably seat within said socket, said spinner part being adapted to extend substantially vertically upwardly within said container side wall and to be substantially uprightly supported when not operating within said container, a cross-extending overhead support means positioned to extend across said container and rest on said side wall, a first magnet carried in a suspended relation on said support means, a second magnet carried by the upper end portion of said spinner and having one pole facing a pole of opposite polarity of said first magnet and in a critically spaced relation with respect thereto, such that manually induced rotative movement of said spinner will be furthered by a substantially balanced spaced-apart magnetic force interaction of opposite magnetic polarities exerted by said magnets.

2. A spinner device as defined in claim 1 wherein said first and second magnets exert substantially the same magnetic force in a balanced relation with respect to each other.

3. A spinner device as defined in claim 1 wherein said socket is of a hard material having a relatively low frictional characteristic, and said pivot means also, has a relatively low frictional characteristic.

4. A spinner device as defined in claim 1 wherein means adjustably mounts said first magnet on said support means to adjust its spaced relation with respect to said second magnet to provide a spaced magnetic force relation therebetween such that said first magnet will not draw said second magnet into abutment therewith and that magnetic forces exerted by said magnets will further rotation of said second magnet and thus of said spinner.

5. A spinner device as defined in claim 1 wherein, said container side wall is of upwardly open-end bowl shape, said support means is a lid mounted over the open end of said bowl-shaped side wall, and a threaded adjustable pin extends substantially centrally downwardly through said lid and carries said first magnet on its downward end.

6. A spinner device as defined in claim 1 wherein, said side wall has means adapted to support said spinner in a slightly off-vertical tilted relation when said spinner has ceased to rotate, said spinner is adapted to move into a fully vertically aligned and spaced-apart relation with said first magnet when an initial manual actuation is effected on said spinner, and said spinner is thereafter adapted to continue to rotate in such an aligned relation during spaced-apart magnetic force interaction between said magnets.

7. A magnetically operated rotating spinner device which comprises, a bowl-shaped supporting base having a substantially centrally disposed bearing socket therein and a rim defining an upper open mouth portion thereabout, a spinner part having a pivot means at its lower end adapted to be rotatively positioned within said bearing socket, a lid adapted to be removably mounted in a seated position on said rim over the open mouth portion of said supporting base, a first magnet carried in a downwardly suspended relation by said lid, a second magnet carried by an upper end of said spinner part, said first and second magnets having opposed poles facing each other in a spaced-apart substantially aligned relation when said lid is moved into its seated position on said rim, and said magnets having opposed poles in their spaced-apart relation adapted to enhance upright rotative movement of said spinner and its said pivot means within said socket when said lid is moved to a seated position with respect to the open mouth portion of said bowl.

8. A spinner device as defined in claim 7 wherein an annular collar is mounted within said supporting base adjacent its open mouth portion and is adapted to receive said spinner in a tilted resting position thereon when said lid is removed from its seated relation over the open mouth portion of said supporting base.

9. A spinner device as defined in claim 7 wherein said collar is adapted to aid in initiating a fully vertically upright rotative movement of said spinner when said lid is moved in an angular direction with respect to said support base into a closing-off position with respect to its open mouth portion.

10. A spinner device as defined in claim 7 wherein, means provides and maintains a spaced relation between said first and said second magnets when said lid is in its seated position on said rim such that said second magnet will maintain said spinner in a down position in which said pivot means will rotatably position said spinner in said socket, in an axially aligned operating position with respect to said first magnet and further, such that opposed magnetic forces exerted by said magnets will enhance upright rotation of said spinner.

11. An amusement device as defined in claim 7 wherein, an adjustment means extends substantially centrally downwardly through said lid to carry said first magnet in a suspended relation, and said adjustment means is a threaded stem rotatably adjustably carried by said lid and having a finger grip portion at its upper end.

12. A spinner device as defined in claim 7 wherein, said supporting base is of a bowl shape and has a side wall portion of restricted diameter thereabout in a downwardly spaced relation with respect to its open mouth portion, said spinner is adapted to rest in a tilted position against said side wall portion with its said pivot means in said bearing socket when in operative, said lid is adapted to be moved in an angular relation towards said support base from a side thereof that is opposite the tilted position of said spinner within said side wall portion of said supporting base to a closing-off position with the open mouth portion of said supporting base in such a manner as to automatically effect a rotating spinning movement of said spinner within said support base, and the spaced relation between said pair of magnets when said lid is in a closed position being such that alternative magnetic force exerted by said magnets will promote a substantially continuous aligned spinning of said spinner within said support base and as controlled in its duration by resisting forces such as friction.

13. A spinner device as defined in claim 7 wherein, said supporting base is an upwardly extending transparent bowl and said bearing socket is centrally positioned within an inner base portion thereof, said pivot means is a pointed metal pin element extending downwardly from said spinner into a rotative positioning within said socket, and rotation of said spinner part is initiated by manually moving said lid in an angular direction into a closing-off relation with the open mouth portion of said support base from a side of said supporting base that is opposite to a non-operative positioning of said spinner within said supporting base.

* * * * *